United States Patent [19]

Bamberg et al.

[11] Patent Number: 4,891,553

[45] Date of Patent: Jan. 2, 1990

[54] LEAD METALLIZING PROCESS TO AVOID SEAL OXIDATION

[75] Inventors: William I. Bamberg, San Jose; Keith P. Cordero, Santa Clara, both of Calif.

[73] Assignee: Wolfram, Inc., Scotts Valley, Calif.

[21] Appl. No.: 213,072

[22] Filed: Jun. 28, 1988

[51] Int. Cl.[4] ..... H01J 9/32; H01J 61/36

[52] U.S. Cl. ..... 313/623; 313/113; 362/296; 445/26; 445/43

[58] Field of Search ..... 313/25, 113, 623, 631, 313/634, 633, 635; 362/296, 302, 347, 350; 445/26, 29, 33, 43, 58

[56] References Cited

U.S. PATENT DOCUMENTS

| | | | |
|---|---|---|---|
| 3,259,777 | 5/1961 | Fridrich | 313/184 |
| 4,376,906 | 3/1983 | Szilagyi et al. | 313/332 |
| 4,423,471 | 12/1983 | Gordin et al. | 362/96 |

OTHER PUBLICATIONS

Lemons, *Lighting Design & Application,* Aug. 1978.

Fiat, et al., *Journal of the Society of Motion Picture and Television Engineers,* vol. 84, No. 6, pp. 461–463, (Jun. 1975).

Bamberg, *Electro—Optical Systems Design,* pp. 59–68, (Mar. 1981).

Block et al., *Journal of the SMPTE,* vol. 83, pp. 725–728, (Sep. 1974).

Westinghouse Lamp Information Bulletin, 08–1974.

*Primary Examiner*—Kenneth Wieder

*Attorney, Agent, or Firm*—Zarley, McKee, Thomte, Voorhees & Sease

[57] ABSTRACT

An improved high wattage mercury halide lamp which has the follower rod of the electrode ribbon assembly brazed to a side arm of a quartz arc tube with ductile alloy brazing composition which effectively seals the side arm and the electrode follower to prevent lead oxidation, metal expansion and attendant damage to the integrity of the lamp. The result is longer life high wattage mercury halide lamps.

15 Claims, 1 Drawing Sheet

LEAD METALLIZING PROCESS TO AVOID SEAL OXIDATION

BACKGROUND OF THE INVENTION

This invention relates to high intensity mercury halide lamps, and particularly to improving such lamps so that they can have longer lamp life and be more useful as a lamp in a lightweight mobile lighting fixture that does not need heavy, wind load increasing cooling systems.

High pressure mercury vapor discharge lamps with and without additional chemical additives are well known in the prior art, see for example U.S. Pat. No. 3,654,506. In the typical high intensity mercury halide lamp, a vitreous quartz lamp envelope is filled with argon gas, mercury, plus other metal salts. Protruding into the lamp envelope are two tungsten electrodes, each electrode being connected to a molybdenum foil which is in turn connected to a follower rod which serves as an electrical termination.

High wattage mercury halide lamps were developed in Germany by OSRAM GmbH and are sold by them under the trademark HMI lamps. The HMI lamp is known to be of rugged construction. The quartz envelope has great inherent strength, and there are no especially fragile internal parts. Under normal operating conditions neither shock nor vibration have any significant deleterious effect on the lamp. Because HMI lamps are lightweight and produce high intensity light with a small amount of lamp weight, they are useful for lighting needs in the sports industry and stage and studio uses, where lights are often mounted on a lighting rack in an elevated position. When operated in sealed weatherproof fixtures, temperatures high enough to cause seal oxidation and subsequent failure require the use of external cooling of the lamp ends.

When lights are used in sports lighting and mounted on an elevated rack, the weight of the lamp reflector is a special concern. This is important because such lights, especially in the field of sports lighting are often subjected to high winds. Obviously, the heavier the load the more susceptible to wind damage.

There has therefore been a continuing need for the development of lightweight luminaire assemblies which can be usefully employed in sports lighting, and especially useful for mobile sports lighting, which requires compactness, intense light source, ruggedness and ease of operation. The assignee of the present application has heretofore combined the use of HMI lamps and luminaire assemblies for the special needs of mobile lighting, see for example U.S. Pat. No. 4,423,471 of Dec. 27, 1983, issued to Myron K. Gordin et al.

The Gordin patent, while presenting a successful lighting fixture and luminaire assembly using lightweight high intensity HMI lamps, solves the problem of high temperatures in the HMI lamp by use of an air cooling assembly. In the application described in the Gordin et al. patent, the air cooling assembly was needed in order to provide longer lamp life for HMI lamps when used in the luminaire assemblies there described.

It necessarily follows that providing a fan and cooling assembly itself is costly, increases the weight of the unit, and thus while it increases lamp life, also brings its own accompanying problems.

It is a primary objective of the present invention to provide an improved high wattage mercury halide lamp which can be used in the manner described in U.S. Pat. No. 4,423,471 of Dec. 27, 1983, without the need for an independent cooling system.

Another objective of the present invention is to provide a lamp assembly for high wattage mercury halide lamps which slows seal degradation caused by lead oxidation, as explained below.

High intensity mercury halide lamps of the general construction described herein have electrical termination rods which protrude from the lamp side arm. These are connected to electrical leads and caps placed thereon. These high intensity mercury halide lamps are filled with mercury and argon to achieve an arc discharge. Typically they also have metal salts added to the arc tube to provide good spectral balance and color rendition similar to sunlight within the tube. These are well-known. The HMI lamp envelope is unique in that it has a very small internal dimension and very thick walls in order to achieve the high temperatures needed to allow an active halogen cycle to remove evaporated tungsten from the inner quartz wall and redeposit it onto the tungsten electrodes.

It has been discovered that where the temperature at which the outboard electrical rod or pin joins the quartz exceeds 400° C. in the presence of air, the molybdenum ribbon of the electrical ribbon assembly will begin to oxidize. When this occurs, since the oxide has larger molecules than the molybdenum itself, it causes an increase in pressure. This increase in pressure gradually will lever the seal of the ribbon assembly open, causing cracks. Eventually this causes lamp fatigue and failure. However, if the lamp assembly is cooled, as for example by the cooling system described in U.S. Pat. No. 4,423,471, preferably to keep the temperature below 400° C., but ideally below 250° C., the failures will be significantly minimized and lamp life extended.

Thus, an important advantage and objective of the present invention is to provide a ductile brazing alloy, which it has been discovered will effectively seal the electrode follower rod to the vitreous quartz lamp arm by a hermetic seal which will not be destroyed by heat, and which a ductility sufficient to compensate for the expansion mismatch between the vitreous quartz and the refractory metal follower rod over the extremes of temperature experienced by the lamp during operation. The result is longer lamp integrity and thus longer life. The achievement of this improved high wattage mercury halide lamp, coupled with the construction and arrangement which allows the use of applicant's discovered certain brazing alloys in combination with the high intensity mercury halide lamps for use in sports lighting without a cooling system is another primary objective of the present invention.

SUMMARY OF THE INVENTION

An improved high wattage mercury halide lamp, which is especially useful in luminaire assemblies which are mounted in an elevated but angular position such as in sports lighting. The assembly can be of reduced weight since the need for an air cooling system is eliminated. The assembly uses a high wattage mercury halide lamp which has an arc tube envelope which carries at its respective sides an electrode ribbon assembly which has protruding therefrom as an electrical connection, a refractory metal follower rod. The follower rod is brazed to the side arm of the quartz tube with a particular alloy brazing material which applicant discovered to provide an especially effective seal. This seal, even at high temperatures prevents foil oxidation, and has sufficient ductility to withstand expansion mismatch and remain hermetic over the operating temperature of the lamp ends, thus preserving lamp life.

DETAILED DESCRIPTION OF THE INVENTION

As heretofore mentioned on several occasions, high wattage mercury halide lamps are known. Moreover, certain improvements in attempts to increase lamp life are known. In this regard, see for example Szilagyi U.S. Pat. No. 4,376,906 issued Mar. 15, 1983 for an ELECTRODE RIBBON SEAL ASSEMBLY for high intensity metal halide lamps. Like the Szilagyi patent, this present invention involves an improvement in high intensity metal halide lamps designed to increase lamp life, and is especially useful for lamps used in luminaire assemblies for sports lighting, which are used in an elevated position while being angularly directed downwards.

Figure 1:
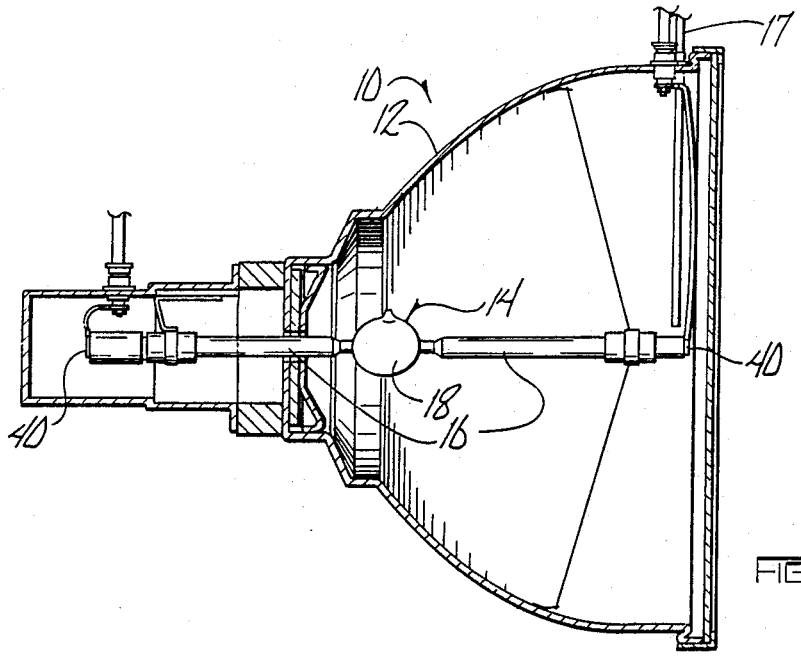
FIG. 1 is a sectional side view of a typical fixture using high wattage mercury halide lamp, as adapted in accordance with U.S. Pat. No. 4,423,471 for a mobile lighting unit, and using an on-site cooling system.

FIG. 1 shows a typical luminaire assembly 10 which is comprised of a reflector 12 having mounted therein a high intensity mercury halide lamp 14. As illustrated in FIG. 1, the rear end of lamp 14 is cooled by use of a special structure which allows cooling air to enter the interior chamber of the reflector 12 via air hose 17. The pressurized air which enters the interior of the luminaire assembly is required, especially to the critical areas of lamp 14 in order that the lamp not self-destruct from the heat generated therein. This problem is especially troublesome at the outer ends of lamp 14. What often may happen at the outer ends of lamp 14 is that electrode ribbon assembly, hereinafter described, is exposed to air at a temperature high enough to cause oxidation, thus weakening the seal. Since the oxidized molecules are larger than the pure metal, increased pressure, eventual splitting of the seal destroys the integrity of the lamp. This reduces lamp life. In fact, it has been discovered that if the temperatures at the lamp ends exceeds 400° 0C., and preferably it should not exceed 250° C., absent cooling, much molybdenum oxidation occurs, leveraging the lamp open with resulting lamp failure. To solve this problem, the apparatus of FIG. 1 has employed an air cooling system. With the mercury halide lamps of the present invention (see FIG. 2) using the improved ductile brazing alloy of the present invention to effectively provide a seal between the electrode ribbon assembly and the quartz lamp, the cooling system hereinbefore described of FIG. 1 is not needed. The result is a lighter-weight luminaire assembly, a less expensive luminaire assembly, and an assembly which is not nearly as complex but which still provides long lamp life In fact, the assembly of the present invention has been found to increase lamp life perhaps as much as 15% to 20% in comparison with the cooling assembly illustrated in FIG. 1.

Figure 2:
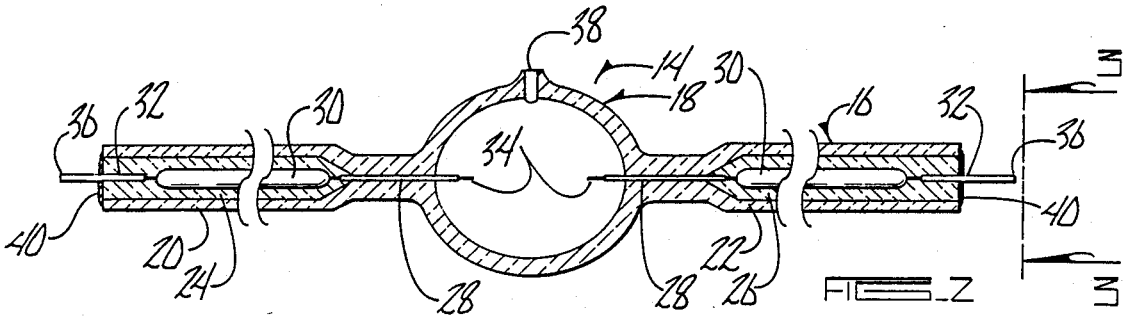
FIG. 2 is a cross-sectional view along the longitudinal axis of a typical lamp assembly for a high intensity mercury halide lamp as used in the luminaire assembly of FIG. 1.
Figure 3:
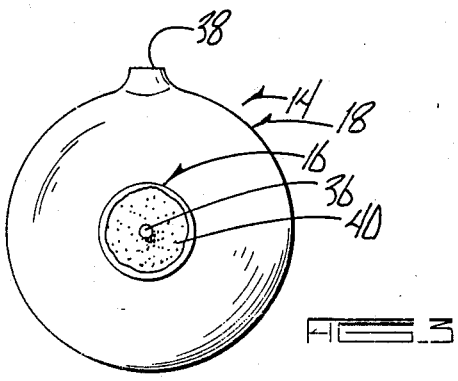
FIG. 3 is a sectional end view of FIG. 2 showing the alloy brazing material and its location of use.

FIG. 2 shows a typical construction of an illustrative high wattage mercury halide lamp which can be mounted in the luminaire assembly of FIG. 1. When the lamp of FIG. 2 uses the improved seal of the present invention, it eliminates the need for the air cooling system illustrated in FIG. 1. It also shows, for illustrative purposes only, use of the improvements in high intensity metal halide lamp construction shown in U.S. Pat. No. 4,376,906. It is, however, understood that other high intensity metal halide lamps could be used and the important aspect is not the precise lamp construction, but merely that the electrode assemblies be sealed to the vitreous quartz lamp envelope by use of the ductile brazing alloy of the present invention.

In FIG. 2, lamp 14 is constructed of a glass arc tube, preferably vitreous quartz arc tube 16, having an arc tube envelope 18 and a pair of opposing side arms 20 and 22, as illustrated in FIG. 2, side arms 20 and 22 can contain therein a pair of electrode assemblies 24 and 26. Side arms 20 and 22 matingly receive the electrode assemblies 24 and 26 which are each intimately fused into the side arms 24 and 26 by conventional means. For details of this fusion, see U.S. Pat. No. 4,376,906. However, as earlier discussed, this particular structural assembly of the high wattage mercury halide lamp is shown for illustrative purposes only, and other high wattage mercury halide lamp assemblies may also be used.

The electrode ribbon assembly 24 and 26 are of light construction. Each comprises a tungsten electrode 28 attached to molybdenum ribbon foil 30, with the foils in turn attached to electrical terminator 32. As illustrated, end 34 of each tungsten electrode 28 extends into the interior chamber defined by arc tube envelope 14. At the opposite end, electric follower rod 36 protrudes from side arm 20 and 22, respectively.

In completing the assembly of the high intensity metal halide lamp 14, the arc tube envelope 18 is filled with the proper components of argon, mercury and metal salts, and the tube is sealed at portal 38. The side arms are cut at the appropriate lengths to expose the electrical terminators 36 in order that electrical connections for the end caps 40 (see FIG. 1) can be made. It is the electrical juncture between the electrical terminator 36 and the end caps as illustrated in FIG. 1 at 40 which utilize the alloy brazing paste of the present invention.

In the past, the applicant has tried numerous brazing alloys and solder glasses in an effort to provide an effective seal which will not have lead oxidation at the high temperatures generated in high wattage mercury halide lamps, all without success. An ideal brazing alloy must effectively adhere to the quartz tube side arms, and as well to the electrical follower rod end 36. Moreover, the seal must be capable of withstanding the high temperatures generated in high wattage mercury halide lamps and remain ductile enough to tolerate the strain caused by expansion mismatch between the quartz and metal being joined hermetically. Typically temperatures at the ends of the lamps on the side arms may reach as high as from 250° C. to 400° C. Ideally the temperature should be kept below 250° C. to prevent seal destruction. Always the temperature should be kept below 400° C. for as long as possible. Doing so will decrease the lead oxidation risk. When this temperature control is done by preserving lamp integrity with the brazing alloy of the present invention, without use of air cooling, lamps having a typical guarantee average life of 200–300 hours (600 watt HMI lamp), the life may be increased by as much as 15% to 20%. It is believed this is because of the effective seal, insulating the internal electrode assembly from oxygen and the damaging effects of oxidation.

The metallizing process of this invention uses a preferred brazing alloy paste composition which is a eutectic alloy mixture of silver, copper and indium. Optionally, the composition may include a nucleating agent such as titanium hydride. Ideally, the composition comprises from about 10% by weight to 20% by weight indium, from about 20% by weight to about 30% by weight copper, and from about 50% by weight to about 70% by weight of silver. In all compositions the amount of indium should not be less than 10%. In a preferred composition the composition is 61.5% silver, 24% copper and 14.5% indium. The preferred composition is commercially available from Lucas-Milhaupt, Inc. and sold under the trademark LUCANEX BRAZING PASTE 616. This preferred composition is described in technical data sheets available from Lucas-Milhaupt, Inc. of 5656 South Pennsylvania Avenue, Cudahy, Wis. 53110. It has a remelt solidus of 620° C., a remelt liquidus of 710° C., a specific gravity of 9.8, a density in troy oz/cu inch of 5.19, and electrical conductivity (9 IACS) of 16, an electrical resistivity of 10.70 microhm/cm, and a recommended brazing range of from 790° C. to 890° C. The composition also contains an inert binder system, which as those skilled in the art know, is conventional, which burns at the alloying temperature leaving no residue. The alloy material (paste) is light brown in color, has a powder mesh size of less than 140 U.S. standard sieve, and a paste viscosity within the range of 350,000 cps to 300,000 cps.

Optionally, the alloy can be used in a wire loop form or as preformed washers. A nucleating agent, i.e. titanium hydride, is applied separately by suspending it in a binder, painting it over the seal area and allowing it to dry.

In using the paste of this invention to seal the electrical terminator rod, standard cleaning methods are used to remove grease, scale, etc. in preparation for brazing. The alloy composition is then heated to within the range of from about 790° C. to about 900° C. and a small bead of the brazing alloy is placed on the electrical terminator rods at the end of the lamp. The lamp is then heated up to just barely incandescent and allowed to sit for 5 minutes. The electrical leads are then brazed on and the end caps (see FIG. 1) are then cemented on by conventional means. In testing, these lamps have been shown to have a 15% to 20% increased lamp life. It therefore can be seen that the invention accomplishes at least all of its stated objectives.

What is claimed is:

1. An improved high wattage mercury halide lamp comprising:

(a) a vitreous quartz arc tube envelope having a pair of opposing side arms, each adapted for partial receipt and containment of an electrode ribbon assembly;

(b) said electrode ribbon assembly having a tungsten electrode which protrudes into said arc tube at one end and at its other end is attached to a molybdenum foil ribbon sealed in the side arm which is electrically connected to an electrode follower rod which partially extends out of the side arm;

(c) said follower rod being brazed to said side arm of said tube and to an electrical lead for attachment to an electrical power source for said lamp with an alloy brazing material which effectively seals said side arm, said electrical lead and said electrode follower rod to prevent ribbon assembly oxidation and attendant expansion damage to the integrity of said lamp.

2. The lamp of claim 1 wherein said brazing alloy paste comprises from about 50% to about 70% silver, from about 20% to about 30% copper, and not less than 10% indium, with the overall amount of indium not exceeding about 20% by weight.

3. The lamp of claim 2 wherein the composition is about 61.5% silver, about 24% copper, and about 14.5% indium.

4. The composition of claim 1 wherein said composition includes a nucleating agent.

5. The composition of claim 4 wherein the nucleating agent is a titanium hydride.

6. A method of improving high wattage mercury halide lamps which have an electrode assembly which itself has an electrode follower rod protruding from the side arm of a quartz arc tube, said electrode follower rod being adapted for connection to an electrical lead for attachment to an electrical power source, said method comprising brazing said electrical follower rod and said quartz side arm and the electrical lead together with a brazing alloy which effectively seals said side arm to said electrode follower rod and said electrical lead to prevent oxidation of the components of the electrical ribbon assembly.

7. The method of claim 6 wherein said brazing alloy composition is from about 50% to about 70% silver, from about 20% to about 30% copper, and not less than 10% indium, with the overall amount of indium not exceeding about 20% by weight.

8. The method of claim 7 wherein the composition is about 61.5% silver, about 24% copper, and about 14.5% indium.

9. The method of claim 6 wherein said composition includes a nucleating agent.

10. The method of claim 9 wherein the nucleating agent is a titanium hydride.

11. An improved luminaire assembly which is lighter in weight than conventional assemblies, and which does not need an air cooling system, and which is adapted for use with high wattage mercury halide lamps, said assembly comprising:

(a) a hemispherical hollow reflector having a rear apex and a front end;

(b) a socket having one open end for reception of a lamp, said socket being connected to said rear apex end of said reflector;

(c) a high wattage metal halide arc lamp having a pair of opposing side arms, each adapted for receipt of an electrode ribbon assembly;

(d) said electrode ribbon assembly having a tungsten electrode which protrudes into said arc tube at one end and at its other end is attached to a molybdenum foil ribbon sealed in the side arm which is electrically connected to an electrode follow rod which partially extends out of the side arm; and (e) said follower rod being brazed to said side arm of said arc tube with an alloy brazing paste which effectively seals said side arm, said electrode follower rod and an electrical lead for attachment to an electrical power source to prevent oxidation and metal expansion damage to the integrity of said lamp.

12. The lamp of claim 11 wherein said brazing alloy paste comprises from about 50% to about 70% silver, from about 20% to about 30% copper, and not less than 10% indium, with the overall amount of indium not exceeding about 20% by weight.

13. The lamp of claim 12 wherein the composition is about 61.5% silver, about 24% copper, and about 14.5% indium.

14. The composition of claim 11 wherein said composition includes a nucleating agent.

15. The composition of claim 14 wherein the nucleating agent is a titanium hydride.

* * * * *